US006581936B1

(12) United States Patent
Zoccolillo et al.

(10) Patent No.: US 6,581,936 B1
(45) Date of Patent: Jun. 24, 2003

(54) CASINO CARD GAME

(75) Inventors: Alan F. Zoccolillo, White Plains, NY (US); Terese A. Zoccolillo, White Plains, NY (US)

(73) Assignee: Z Gaming, LLC, White Plains, NY (US)

( * ) Notice: Subject to any disclaimer, the term of this patent is extended or adjusted under 35 U.S.C. 154(b) by 0 days.

(21) Appl. No.: 10/014,385

(22) Filed: Dec. 11, 2001

(51) Int. Cl.[7] ..... A63F 1/00
(52) U.S. Cl. ..... 273/274; 273/309
(58) Field of Search ..... 273/274, 292, 273/309

(56) References Cited

U.S. PATENT DOCUMENTS

| | | | | |
|---|---|---|---|---|
| 5,397,128 A | | 3/1995 | Hesse et al. | 273/292 |
| 5,711,525 A | * | 1/1998 | Breeding | 273/292 |
| 5,713,574 A | | 2/1998 | Hughes | 372/292 |
| 5,813,673 A | | 9/1998 | Richardson | 273/292 |
| 5,853,325 A | | 12/1998 | Kadlic | 463/13 |
| 5,975,529 A | * | 11/1999 | de Keller | 273/292 |
| 5,984,310 A | | 11/1999 | English | 273/292 |
| 5,997,002 A | | 12/1999 | Goldman | 273/292 |
| 6,102,402 A | * | 8/2000 | Scott et al. | 273/292 |
| 6,113,101 A | * | 9/2000 | Wirth | 273/274 |
| 6,131,907 A | * | 10/2000 | Nucifora et al. | 273/292 |
| 6,131,908 A | | 10/2000 | Palmer | 273/292 |
| 6,158,741 A | | 12/2000 | Koelling | 273/292 |
| 6,189,888 B1 | * | 2/2001 | Brunelle | 273/292 |
| 6,234,485 B1 | * | 5/2001 | Perkins | 273/292 |
| 6,279,910 B1 | | 8/2001 | de Keller | 273/292 |
| 6,454,266 B1 | * | 9/2002 | Breeding et al. | 273/292 |

* cited by examiner

*Primary Examiner*—William M. Pierce
(74) *Attorney, Agent, or Firm*—Webb Ziesenheim Logsdon Orkin & Hanson, P.C.

(57) ABSTRACT

A casino card gaming method utilizes a conventional fifty-two card deck and begins by first determining the players for a given round. Players may select to be eligible for a bonus card. The individual players' hands, a set of common cards and a bonus card for players eligible for the bonus card are dealt. Players which continue through the round determine whether to play the hand as dealt or to utilize the common cards. Players utilizing the common cards discard a number of cards from their hands equal to the number of common cards. The relative ranking of the final hands for the players is determined with the relative ranking based upon the statistical likelihood of obtaining predetermined combinations of cards. The relative ranking accounts for the use of the set of common cards and the bonus card.

20 Claims, 2 Drawing Sheets

CASINO CARD GAME

BACKGROUND OF THE INVENTION

FIELD OF THE INVENTION

The present invention relates to a gaming system, and more particularly, relates to a casino card gaming system.

BACKGROUND OF THE INVENTION

Numerous card gaming systems have been developed for entertainment purposes. Many of these card gaming systems have been adapted for use in casino wagering card games, such as blackjack and poker, to name a few. The development of successful casino card games must address several distinct criteria.

As with all successful games, a successful casino card game must be sufficiently entertaining for the players. In order to be sufficiently entertaining, a card game must balance many, often competing factors. These factors include complexity and challenge of game play, the pace of game play, the element of chance, the level of player skill and strategy, and the amount of player interaction.

Aside from the effect on the entertainment value of the game, the complexity of game play is of practical importance to casino type wagering games. Unduly high complex rules of game play will prevent the attraction of new players to a casino game. Simplicity of game play allows the game to be easily accessible to all; however, overly simplistic game play often results in an unchallenging and unentertaining game.

The pace of game play is also of unique importance for a successful casino game. The rapid turnover, or cycle time, in the wagering rounds is preferred in a casino game to maximize the wagering cycles of the game. This must also be balanced against how the pace of the game play affects the entertainment offered by the game. In other words, at some point, further increasing the speed of the game will reduce the entertainment value of the game.

Regarding the element of chance, it is a hallmark of casino type games that the element of chance plays a substantial role in the game. A game based solely on skill may tend to inhibit new players in a casino game environment. However, in most casino card games, winning is based on a combination of skill and the element of chance, wherein a player's increased skill will increase his likelihood of winning particularly through repeated play. Consequently, the element of chance and the level of player skill and strategy necessary are both of importance.

As noted above, the amount of player interaction associated with the game is one of the elements factored into the entertainment that the game provides for the players. Player interaction concerns both the player's involvement with the game and the player's involvement with the remaining players. Further, in casino games, there is concern over the amount or effect of one player's actions on the remaining players. This is particularly true in games in which the players are playing primarily against the house (i.e., not directly against other players). In other words, it can be a problem in certain casino card games where one player's "poor play" is viewed by the remaining players as adversely affecting their likelihood of winning.

There is a continuous need in the casino gaming industry to develop entertaining games providing a new fresh look and feel which successfully balances all of the game factors including those discussed above. It is an object of the present invention to provide a casino card game successfully balancing these factors. It is a further object of the present invention to provide a gaming method based upon utilizing a conventional fifty-two card deck of cards. It is another object of the present invention to provide a casino card gaming table specifically accommodating a casino card gaming system balancing all of the above factors.

SUMMARY OF THE INVENTION

The objects of the present invention are achieved by providing a card gaming method utilizing a conventional fifty-two card deck of cards and card gaming table according to the present invention. The gaming method according to the present invention includes determining the players for a given round prior to dealing the hand of cards to each of the designated players for the round. The method includes determining which of the designated players are eligible for at least one bonus card in a given round. A hand of cards is dealt to each of the designated players for a given round with each player's hand consisting of the same number of cards. A set of common cards is provided for the given rounds and at least one bonus card is provided for the players eligible for the at least one bonus card in a given round. The bonus card, or cards, may be utilized by the players eligible for the at least one bonus card and those players' final hands. The players which continue through the given round will determine whether they wish to utilize the common cards as part of the players' hands or not. Each player utilizing the common cards will discard from that player's original hand a number of cards equal to the number of common cards. The discarded cards are not part of the player's final hand. The relative ranking of the final hand for each player that continues through the round is determined wherein the relative ranking is generally based upon the statistical likelihood of determining a predetermined combination of cards in which the relative ranking accounts for the use of the set of common cards and the at least one bonus card.

In one preferred embodiment of the present invention, the card gaming method is specifically a casino card gaming method utilizing a conventional fifty-two card deck of cards. The determination of players for a round is through receipt of ante wagers by the players for a given round. The determination of players eligible for at least one bonus card is through receipt of a bonus wager from players electing to be eligible for at least one bonus card. Additionally, the determination of the relative ranking of the final hand for each player results in a paying out of players based upon the final ranking.

In a preferred embodiment of the present invention, each hand as dealt has seven cards and each final hand has at least seven cards. Additionally, in a preferred embodiment of the present invention, the set of common cards comprises two common cards, and only a single bonus card is provided to the players eligible for the bonus card. Each final hand of the players eligible for the bonus card comprises eight cards and each final hand of the remaining players will be seven cards. A preferred embodiment of the present invention provides that the single bonus card is common to all of the players eligible for the bonus card.

In one preferred embodiment of the present invention, the predetermined combinations or rankings of the final hand are combinations of four, three and two of a kind. In one embodiment of the present invention, the ranking of the predetermined combination represents four and three of a kind unassisted; four and four assisted; four of a kind unassisted; four and three of a kind assisted; three and three of a kind unassisted; four of a kind assisted; three and three of a kind assisted; three and two of a kind unassisted; three of a kind unassisted; three and two of a kind assisted; and three of a kind assisted. The term "assisted" is intended to refer to a final hand of a player eligible to use either the bonus card and/or the common cards, and the term "unassisted" refers to a final hand of a player not eligible to use either the bonus card or the common cards.

In one embodiment of the present invention, the set of common cards are selectively revealed wherein following the dealing of the first common card is the ability to anchor or protect at least one or a portion of the ante wager of the players. The anchoring of an ante wager, or portion thereof, in this embodiment of the present invention assures that at least the anchored wager will not be lost if the first dealer card is not to the player's advantage.

In another embodiment of the present invention, there is a determination of which players continue through the given round following the dealing of the original hands. The determination of which players are continuing through the given round may be accomplished by receiving matching bets by those players electing to continue through the given round.

The present invention additionally provides a casino type card game table for playing the casino card game of the present invention. The gaming table provides positions for a dealer and up to six players, a predetermined area for receiving ante wagers for all of the players of a given round prior to the dealing of a hand of cards to each of the designated players for a given round. The table additionally includes: a predetermined area for receiving a bonus wager from each of the players who elect to be eligible for at least one bonus card in a given round; a predetermined area for receiving a hand of cards for each of the designated players for a given round with each player receiving the same number of cards; a predetermined area for receiving a set of common dealer cards for a given round; a predetermined area for receiving one common bonus card for the players eligible for at least one bonus card in a given round; and a predetermined area for receiving discarded cards from the players. In one embodiment of the present invention, the gaming table may include a predetermined area for receiving at least one "anchor" from the players of a given round. In one embodiment of the present invention, the gaming table includes a predetermined area for receiving matching wagers by all of the players continuing through the given round. In a further embodiment of the present invention, the gaming table further includes a display of the relative ranking and payout schedule for the game.

These and other objects of the present invention will be clarified in the Brief Description of the Preferred Embodiments taken together with the attached drawings wherein like reference numerals represent like elements throughout.

DESCRIPTION OF THE PREFERRED EMBODIMENTS

The present invention is directed toward a card gaming method utilizing a conventional fifty-two card deck of cards. More specifically, the present invention relates to a casino wagering card gaming method utilizing a conventional fifty-two card deck of cards. As well understood by those in the art, a conventional deck of cards includes thirteen ranks consisting of two, three, four, five, six, seven, eight, nine, ten, jack, queen, king and ace, with four suits of each rank, namely, diamond, heart, club and spade.

Figure 1:
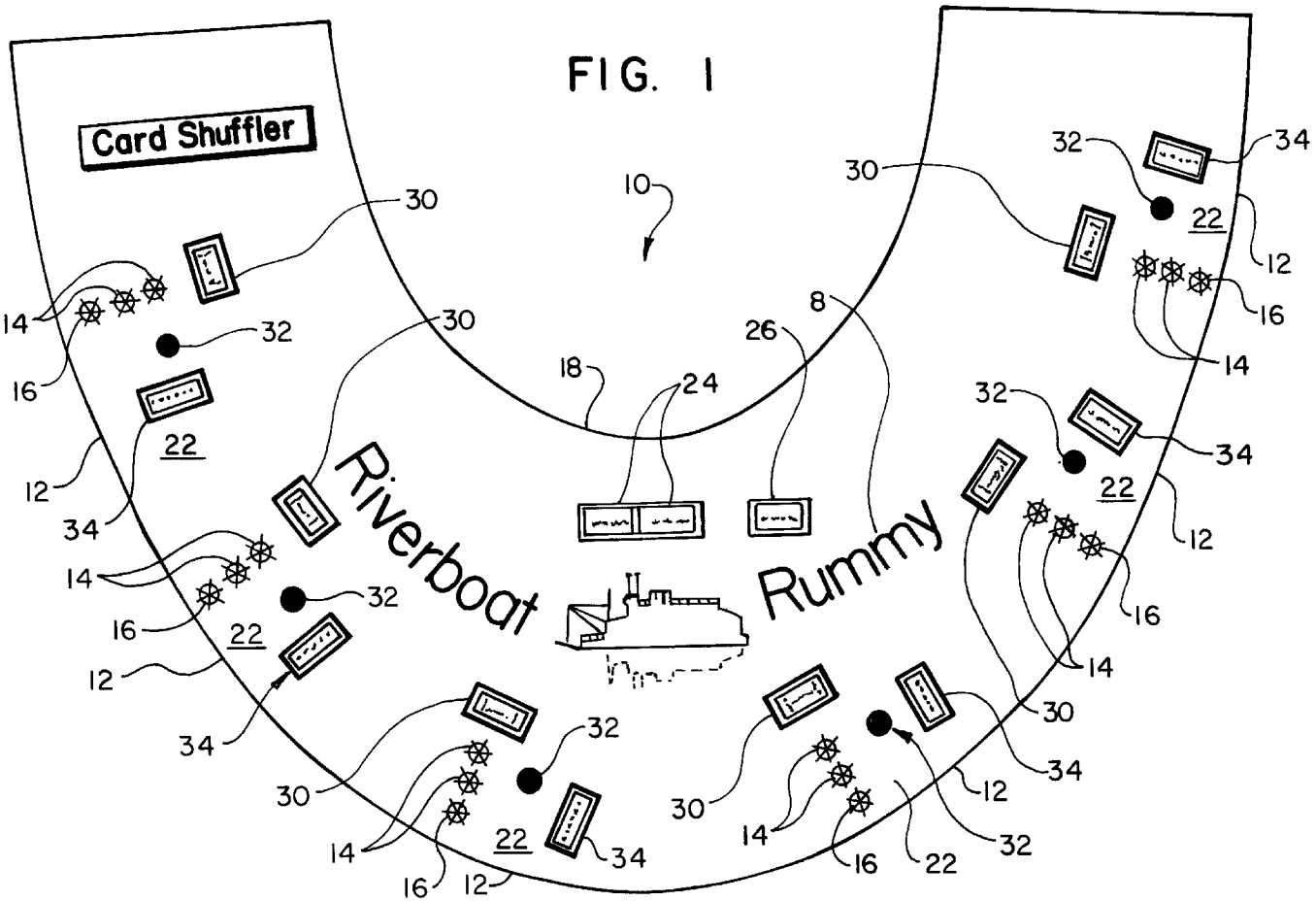
FIG. 1 schematically illustrates a gaming table for a casino type card game according to the present invention.
Figure 2:
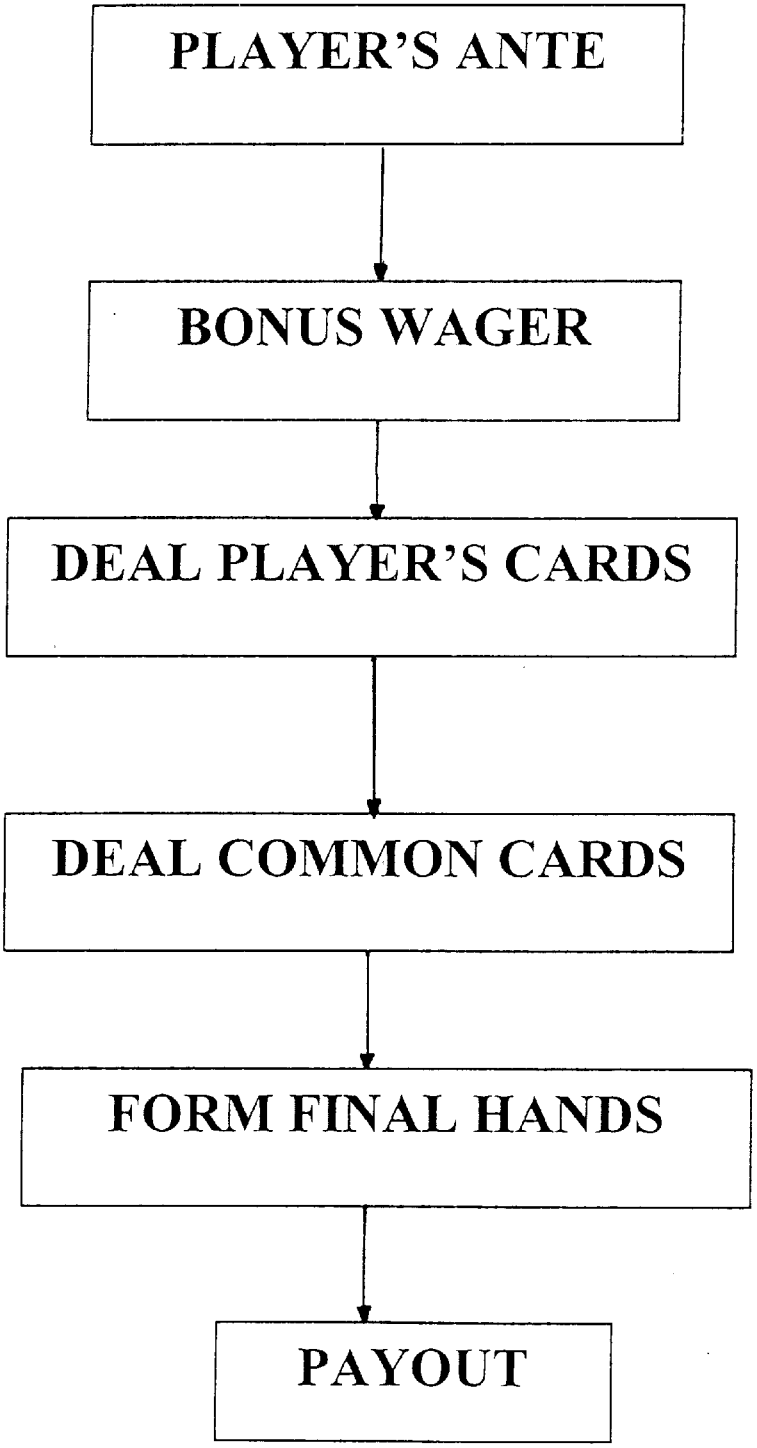
FIG. 2 is a schematic flowchart of a method of playing the casino type card game according to the present invention.

The casino card gaming method of the present invention may be played on the gaming table 10 illustrated in FIG. 1 which is specifically adapted for playing the game of the present invention as will be described hereinafter. The casino card gaming method of the present invention is played repeatedly in independent rounds, one round of which is illustrated in the flowchart of FIG. 2 as discussed below. As with poker or blackjack, new players can come and go after every given round.

The given round in the method of the present invention begins by determining the players for the given round prior to dealing the hand of cards to each of the designated players for that round. This determination is most easily accomplished by receiving ante wagers by all of the players of a given round. Referring to table 10, any of up to six players generally at player positions 12 can elect to play for a given round by providing an ante wager on the predetermined area 14 for receiving ante wagers for each of the given players. The table 10 may include a title or other explanatory text 11, such as "Riverboat Rummy" and logo, which are trademarks of Z Gaming, LLC. The explanatory text 8 on the table 8 may also include rules and/or payment information to assist the players. The amount of the ante wager can be determined by the casino and may even be reflected by text in the area 14 for receiving the ante wagers. Such explanatory text in various locations on the table 10 will assist new players in understanding the game and increase game play and playability. Additionally, one aspect of the present invention provides that the ante wager may be in two equal portions or may be considered as two ante wagers for each player. The provision of the ante wagers (or two equal portions of an ante wager) can provide greater options to the players as will be described later. The placement of two ante wagers may be left to the option of the player or made a game requirement.

The next step in the gaming method of the present invention is determining which of the designated players is eligible for at least one bonus card in the given round. As with the ante wagers, the determination of who receives at least one bonus card is made by the players. Those players electing to receive at least one bonus card will place a bonus wager in area 16 on the table 10 adapted to receive the bonus wager. The area 16 may also include explanatory text, be color-coded or otherwise identifiable. The election to receive the one or more bonus cards is solely up to the players providing an important variability in play to the present invention. Essentially, the players are paying for the additional card or cards through the bonus wager, and the use of the bonus card or cards is further accounted for in the relative ranking of the final hands. The use of bonus cards is believed to provide an important amount of variability to the game, increasing game play by providing strategy components to improve player interest as well as providing an additional income or wagering component for the casino.

Following the designation of players and those eligible for the bonus card or cards, a hand of cards is dealt to each of the designated players for a given round with each player receiving a player's hand comprising the same number of cards. In general, each player's hand will be provided (i.e., dealt) by the dealer operating from a dealer's position 18 and who positions each player's hand in an area 22 in front of the player's area 12. The player's hand as dealt may be face down or face up. The dealing of the cards face up may allow the casino operators to minimize improper player interaction or possible tampering with the cards. However, providing the hands face down provides a more conventional card game minimizing additional information to the remaining players, such as what is likely or not likely to be in the common cards and bonus cards. Additionally, a face down dealing of the cards allows for additional variations in the game of the present invention including subsequent wagering, and reward for the best player's hand. Consequently, a face down dealing of the player's hand is preferred, but is not the only manner of playing the game of the present invention. In addition to dealing the hands of cards to each of the players for the round, the dealer will deal a set of common cards or dealer cards for a given round. Specifically, it is preferred that the set of common cards, also called assistance cards, comprise two cards positioned in the predetermined area 24 on the table 10 for receipt of the common cards. It is preferred that the set of common cards be dealt in a face down manner by the dealer, although variations of the present invention may allow a face up presentation of the common cards.

Additionally, the dealer will provide at least one bonus card for all of the players eligible for the at least one bonus card for a given round. In the preferred embodiment of the present invention, the bonus card is a common bonus card positioned face down in an area 26 for receiving a common bonus card for use by the players eligible for at least one bonus card in a given round. The bonus card may be dealt in a face down orientation, as preferred, or a face up orientation in other variations of the present invention. Placing it face down or face up allows for different variations in the game by changing when the players who are eligible to utilize the bonus card receive this information of the identify of the bonus card.

Following the dealing of the hands of cards to the designated players, the dealing of the common cards and the provision of the bonus cards, one embodiment of the present invention provides for determination of which players are continuing through the given round. This may be accomplished by receiving matching wagers by those players desiring to continue in a given round. The players can make this determination independently after reviewing their hands as dealt. It is preferred that in this variation of the game, the players not see the set of common dealer cards before determining whether they wish to continue play. A further variation would be to require those players who are elected to be eligible for the bonus card to provide a matching bonus wager in order to continue to be eligible for the bonus card through the given round. Whoever is eligible for the bonus card can utilize the bonus card in the player's final hand. The matching wagers and/or matching bonus wager represents just one variation of the casino card gaming method of the present invention. The matching wagers and matching bonus wagers may be eliminated without changing the fundamental aspects of the game.

Each player continuing through the given round must now determine whether they wish to utilize the hand as dealt or utilize the common dealer's cards as part of the player's hand. The players make this determination independently. Each player utilizing the set of common cards will discard from the player's hand as dealt a number of cards equal to the number of common dealer cards. The discarded cards are not part of the player's final hand. Players can discard the cards on the table 10 in the area 30 designated for receiving discarded cards from the players.

Following the determination by the players of whether they will stay with their hands as dealt or utilize the common cards in the preferred embodiment of the present invention, the dealer will turn over the common dealer's cards for the players. This step allows for another variation within the gaming method of the present invention. The gaming method of the present invention may allow for an "anchoring" of one ante wager or a portion thereof by one of the players utilizing the common cards after the first dealer card is revealed. The anchored wager in the method of the present invention will keep the player with the "anchored" wager in the game and assure that at least one of the bets will not be lost if the first dealer's common card is not to the player's advantage. The table 10 can include an area for receiving an "anchor" 32. The anchor 32 may also be eliminated from the casino card gaming method of the present invention without changing the overall game play of the present invention. The anchoring variation of the present invention is intended where a player provides at least two equal ante wager portions, or two ante wagers, and the player is allowed to anchor one of the ante wagers in those situations where a dealer's card is not to the player's advantage. This anchor will prevent the player from losing the anchored ante wager; however, any winning will not be paid out on an anchored wager. In overview of the anchor, a player is dealt seven cards which the player does not feel he wishes to utilize in the final hand and discards two. This anchor provision allows the player to "save" one, or a portion of, the ante wager and to improve player participation, increase the number of players playing through the entire round and generally provide further variations for increased interest and overall improved game play.

Following the disclosure of the common cards to the players, the players will be paid out based upon the relative ranking of the final hand for each of the players continuing through the round. The payment may be in area 34 provided on table 10. The relative ranking is generally based upon the statistical likelihood of obtaining predetermined combinations of cards wherein the relative ranking accounts for the use of the set of common dealer cards and the at least one bonus card. It is preferred that the gaming method of the present invention use predetermined combinations that are four, three and two of a kind so that the game is generally similar to rummy. The following payout is a possible representation of a suggested payout schedule of the casino card gaming method of the present invention:

| | |
|---|---|
| four and four of a kind assisted | 1000–1; |
| four and three of a kind unassisted | 500–1; |
| four of a kind unassisted | 100–1; |
| four and three of a kind assisted | 50–1; |
| three and three of a kind unassisted | 20–1; |
| four of a kind assisted | 10–1; |
| three and three of a kind assisted | 7–1; |
| three and two of a kind unassisted | 4–1; |
| three of a kind unassisted | 3–1; |
| three and two of a kind assisted | 2-1; and |
| three of a kind assisted | 1-1. |

The term "assisted" in the above payout schedule refers to a final hand of a player which is eligible to utilize either the bonus card or the common dealer's cards. The term "unassisted" in the above payout schedule refers to a final hand of a player not eligible to use either the bonus card or the common dealer's card. Consequently, it will be readily understood that while the use of the bonus card and/or the common cards increases the likelihood of obtaining a winning type combination, the payout for any such winning type combination is appropriately reduced. In the variation discussed above where a player is allowed to anchor a portion of the ante bet, the payouts will be made on the unanchored ante bet only. Another obvious variation would be to have the terms "assisted" refer to a final hand of a player which is eligible and actually utilizes either a bonus card or the common dealer's cards in the designated winning combination. The listed payouts may be adjusted as desired.

It will be understood that in the preferred method of the present invention, each player's hand is seven cards, the common cards are two and there is a single common bonus card. This number allows a standard fifty-two card deck of cards to accommodate six players in every round. This allowance suggests that each player's final hand will be seven cards except for those players eligible for a bonus card in which their final hand will consist of eight cards, which is reflected in the payout schedule discussed above. Variations in the number of cards in a player's hand, number of common cards and number of bonus cards are possible with the present invention.

The casino type card gaming method of the present invention is believed to successfully balance all of the criteria necessary for providing a successful casino card game. The rules of the game are quite simple generally based on the card game rummy, which is familiar to many players; however, there is sufficient challenge in game play to maintain player interest. The pace of game play, i.e., the amount of time for each given round, is believed to be at an appropriate level to maintain player interest and yet be effective for casino play. There is a sufficient element of chance in every given round to prevent the game from being dominated by solely highly skilled players, yet the game does provide sufficient variation to allow the players to develop skills and strategies for continued game play. Finally, the game provides a certain amount of player interaction having the players select whether to stay with the hands as dealt or to utilize the common cards, whether to use a bonus card or not, and in the various game variations whether to anchor a portion of the ante bet or whether to match an ante bet. The level of player interaction is believed to increase the entertainment of the card game. Additionally, one player's play in the present game is not believed to sufficiently affect the remaining players.

There are further possible variations to the casino type card gaming method of the present invention aside from the specifics described herein. For example, the casino may provide an additional payout to the player having the best relative hand of the players in a given round. This variation may be more relevant in the matching wager variation in which players must decide whether to pay to stay in. The matching wagers may actually form the pot for paying out the player having the best relative final hand. Numerous variations of the basic aspects of the casino card gaming method of the present invention are possible within the spirit and scope of the present invention. For example, in place of the dealer and the players playing against the house, the entire game may be played among the players, with the respective players taking turns as the dealers. In such a variation, the ante wager, the bonus wager, and the matching wager if utilized, would generally form a pot which would be won by the player having the highest relative ranking of the final hand. It can be envisioned that a casino utilizing the casino card gaming method of the present invention may also provide instructions and/or a preprinted table top surface, such as illustrated in FIG. 1 (without the dealer location) to encourage players to learn and play the game. This may increase the awareness of the casino type card game and increase the interest for play at the casino.

It will be apparent to those of ordinary skill in the art that various modifications may be made to the present invention without departing from the spirit and scope thereof. The scope of the present invention is defined by the appended claims and equivalents thereto.

We claim:

1. A card gaming method utilizing a conventional fifty-two card deck of cards, the gaming method comprising the steps of:

determining the players for a given round prior to dealing a hand of cards to each of the designated players for the given round;

determining which of the designated players is eligible for at least one bonus card in the given round;

dealing a hand of cards to each of the designated players for a given round, wherein each player hand as dealt has the same number of cards;

providing a set of common cards for the given round;

providing at least one bonus card for the players eligible for at least one bonus card in the given round, wherein the at least one bonus card may be utilized by the player in the player's final hand;

determining which of the players continuing through the given round may utilize the common cards as part of the player's final hand, wherein the players utilizing the common cards will discard from the player's hand as dealt a number of cards equal to the number of common cards, and wherein the discarded cards are not part of the player's final hand; and determining the relative ranking of a final hand for each player that continued through the round, wherein the relative ranking is generally based upon the statistical likelihood of obtaining predetermined combinations of cards and wherein the relative ranking accounts for the use of the set of common cards and the at least one bonus card.

2. The gaming method of claim 1 wherein each hand as dealt has seven cards.

3. The gaming method of claim 2 wherein each final hand has at least seven cards.

4. The gaming method of claim 3 wherein the set of common cards is two common cards.

5. The gaming method of claim 4 wherein only a single bonus card is provided to the players eligible for a bonus card, wherein each final hand of a player eligible for a bonus card is eight cards and each final hand of the remaining players is seven cards.

6. The gaming method of claim 5 wherein the single bonus card is common to all the players eligible for the bonus card.

7. The gaming method of claim 6 wherein the predetermined combinations are of four, three and two of a kind.

8. The gaming method of claim 7 wherein the ranking of the predetermined combinations is as follows:

four and four of a kind assisted, four and three of a kind unassisted, four of a kind unassisted, four and three of a kind assisted, three and three of a kind unassisted, four of a kind assisted, three and three of a kind assisted, three and two of a kind unassisted, three of a kind unassisted, three and two of a kind assisted, and three of a kind assisted, wherein the term assisted refers to a final hand of a player eligible to use either the bonus card or the common cards and unassisted refers to a final hand of a player not eligible to use either the bonus card or the common cards.

9. A casino type card gaming method utilizing a conventional fifty-two card deck of cards, the casino gaming method comprising the steps of:

receiving ante wagers by all of the players for a given round prior to dealing a hand of cards to each of the designated players for the given round;

receiving a bonus wager from each of the players who elects to be eligible for at least one bonus card in the given round;

dealing a hand of cards to each of the designated players for a given round, wherein each player hand as dealt has the same number of cards;

dealing a set of common dealer's cards for the given round;

dealing at least one bonus card for the players eligible for at least one bonus card in the given round, wherein the at least one bonus card may be utilized by the player in the players final hand;

determining which of the players continuing through the given round may utilize the common dealer's cards as part of the player's final hand, wherein the players utilizing the common cards will discard from the player's hand as dealt a number of cards equal to the number of common dealer's cards, and wherein the discarded cards are not part of the player's final hand; and paying out players based upon the relative ranking of a final hand for each player that continued through the round, wherein the relative ranking is generally based upon the statistical likelihood of obtaining predetermined combinations of cards and wherein the relative ranking accounts for the use of the set of common dealer cards and the at least one bonus card.

10. The casino type gaming method of claim 9 wherein each hand as dealt has seven cards.

11. The casino type gaming method of claim 10 wherein each final hand has at least seven cards.

12. The casino type gaming method of claim 11 wherein the set of common dealer cards is two common cards that are displayed to the players after the players have elected to utilize the common cards, and the players may elect to anchor at least a portion of their ante wagers effectively withdrawing the anchored wagers.

13. The casino type gaming method of claim 11 wherein only a single bonus card is provided to the players eligible for a bonus card and the bonus card is displayed to the players after the players have placed matching wagers, wherein each final hand of a player eligible for a bonus card is eight cards and each final hand of the remaining players is seven cards.

14. The casino type gaming method of claim 13 wherein the single bonus card is common to all the players eligible for the bonus card and up to six players are permitted in each round.

15. The method of claim 14 wherein following the dealing of the players' hands, the players make matching wagers to continue through the round.

16. The method of claim 14 wherein the ranking of the predetermined combinations is as follows:

four and four of a kind assisted, four and three of a kind unassisted, four of a kind unassisted, four and three of a kind assisted, three and three of a kind unassisted, four of a kind assisted, three and three of a kind assisted, three and two of a kind unassisted, three of a kind unassisted, three and two of a kind assisted, and three of a kind assisted, wherein the term assisted refers to a final hand of a player eligible to use either the bonus card or the dealer's common cards and unassisted refers to a final hand of a player not eligible to use either the bonus card or the common dealer's cards.

17. The method of claim 9 further including providing an additional payout to the player having the best relative final hand of the players in the given round.

18. The method of claim 9 wherein each hand as dealt has seven cards, only a single bonus card is provided to each player eligible for a bonus card and the payout is according to the following relative rankings:

four and four of a kind assisted, four and three of a kind unassisted, four of a kind unassisted, four and three of a kind assisted, three and three of a kind unassisted, four of a kind assisted, three and three of a kind assisted, three and two of a kind unassisted, three of a kind unassisted, three and two of a kind assisted, and three of a kind assisted, wherein the term assisted refers to a final hand of a player eligible to use either the bonus card or the dealer's common cards and unassisted refers to a final hand of a player not eligible to use either the bonus card or the common dealer's cards.

19. A casino type card gaming table for a game using a conventional fifty-two card deck of cards the gaming table comprising:

a position for a dealer and up to six players;

a predetermined area for receiving ante wagers by all of the players for a given round prior to dealing a hand of cards to each of the designated players for the given round;

a predetermined area for receiving a bonus wager from each of the players who elects to be eligible for at least one bonus card in the given round;

a predetermined area for receiving a hand of cards for each of the designated players for a given round, wherein each player hand as dealt has the same number of cards;

a predetermined area for receiving a set of common dealer's cards for the given round;

a predetermined area for receiving one common bonus card for the players eligible for at least one bonus card in the given round;

a predetermined area for receiving an anchor of at least a portion of the ante wager for at least one of the players continuing through the given round; and a predetermined area for receiving discarded cards from the players.

20. The gaming table of claim 19 further including a display of the relative ranking and payout schedule.

* * * * *